US009109467B2

(12) United States Patent
Dalsania et al.

(10) Patent No.: US 9,109,467 B2
(45) Date of Patent: Aug. 18, 2015

(54) EXHAUST SYSTEM FOR USE WITH A TURBINE AND METHOD OF ASSEMBLING SAME

(75) Inventors: Prakash Bavanjibhai Dalsania, Bangalore (IN); Antanu Sadhu, Bangalore (IN)

(73) Assignee: General Electric Company, Schenectady, NY (US)

( * ) Notice: Subject to any disclaimer, the term of this patent is extended or adjusted under 35 U.S.C. 154(b) by 570 days.

(21) Appl. No.: 13/542,492

(22) Filed: Jul. 5, 2012

(65) Prior Publication Data

US 2014/0010641 A1 Jan. 9, 2014

(51) Int. Cl.
*F01D 25/30* (2006.01)

(52) U.S. Cl.
CPC ..... *F01D 25/30* (2013.01); *F01D 25/305* (2013.01); *F05D 2220/31* (2013.01); *F05D 2260/601* (2013.01); *Y10T 29/49234* (2015.01)

(58) Field of Classification Search
CPC ... F01D 25/30; F01D 25/305; F05D 2220/31; F05D 2260/601
See application file for complete search history.

(56) References Cited

U.S. PATENT DOCUMENTS

| | | | | |
|---|---|---|---|---|
| 5,257,906 | A * | 11/1993 | Gray et al. | 415/226 |
| 5,603,605 | A * | 2/1997 | Fonda-Bonardi | 415/211.2 |
| 6,602,046 | B2 * | 8/2003 | Kraus | 415/1 |
| 6,896,475 | B2 * | 5/2005 | Graziosi et al. | 415/1 |
| 2012/0121404 | A1 | 5/2012 | Neeli et al. | |

FOREIGN PATENT DOCUMENTS

| | | | |
|---|---|---|---|
| EP | 1921278 | A1 | 5/2008 |

* cited by examiner

*Primary Examiner* — Dwayne J White
*Assistant Examiner* — Brian P Wolcott
(74) *Attorney, Agent, or Firm* — Armstrong Teasdale LLP

(57) ABSTRACT

An exhaust system for use with a steam turbine is provided. An exhaust hood includes an input and an output, the input receiving fluid from the steam turbine. The exhaust hood includes a first side wall that extends between the input and the output. The first side wall includes an aperture. An ejector is coupled to the exhaust hood. The ejector includes inlets and an outlet. At least one of the inlets receives fluid from the exhaust hood via the aperture.

18 Claims, 6 Drawing Sheets

EXHAUST SYSTEM FOR USE WITH A TURBINE AND METHOD OF ASSEMBLING SAME

STATEMENT REGARDING FEDERALLY SPONSORED RESEARCH & DEVELOPMENT

This invention was made with Government support under Contract No. DE-FC26-05NT42643, awarded by the Department of Energy. The Government has certain rights in this invention.

BACKGROUND OF THE INVENTION

The subject matter disclosed herein relates generally to turbine engines and, more specifically, to exhaust systems for use with turbine engines.

Rotary machines, such as steam turbines, may be used to generate power for electric generators. Known steam turbines have a steam path defined within a shell that includes, in serial-flow relationship, an inlet, at least one turbine, and an outlet. Known turbines include at least one row of circumferentially-spaced rotating buckets or blades.

During low-load and/or start up conditions, steam leakage may occur near the inlet due to the high pressure of the incoming steam. Moreover, during the same operating conditions, because a low pressure (LP) section of the turbine is under vacuum, an undesirable amount of atmospheric air may be drawn into the turbine system. At least some known turbine configurations include redundant steam seal systems that facilitate reducing steam leakage during low-load and start up operating conditions. For example, at least some known steam seal systems supply low pressure steam to the steam seals during pre-determined operating conditions. The low pressure steam prevents the ingress of atmospheric air into the LP section of the steam turbine and helps maintain a positive pressure at the high pressure (HP) section of the steam turbine. As turbine load is increased, only a portion of the high pressure and temperature steam directed from the steam seal header is used for sealing purposes, and the remainder is channeled to the condenser. At least some known steam turbines also include an exhaust hood downstream from a last stage of the turbine. Known exhaust hoods help recover the static pressure of the steam and also guide the steam from the last stage of the turbine to the condenser. However, at least some known exhaust hoods require steam to turn about 90° towards the condenser. The abrupt change in the direction of the steam flow may cause the flow of steam to separate within the hood. Flow separation may reduce static pressure recovery and reduce turbine efficiency.

BRIEF DESCRIPTION OF THE INVENTION

In one embodiment, a method of assembling an exhaust system for use with a steam turbine is provided. The method includes coupling an exhaust hood including an input and an output to the steam turbine such that fluid discharged from the steam turbine enters the exhaust hood. The exhaust hood is defined by a first side wall that extends from the input to the output. The first side wall includes at least one aperture defined therein. The method further includes coupling an ejector to the exhaust hood to facilitate reducing flow separation of fluid flowing through the exhaust hood. The ejector includes a plurality of inlets and at least one outlet. At least one of the inlets is receives fluid from the exhaust hood via the aperture.

In another embodiment, an exhaust system for use with a steam turbine is provided. The exhaust system includes an exhaust hood including an input and an output. The input is configured to receive fluid discharged from the steam turbine. The exhaust hood further includes a first side wall that extends between the input and the output. The first side wall includes at least one aperture defined therein. The exhaust system also includes an ejector coupled to the exhaust hood, wherein the ejector includes a plurality of inlets and at least one outlet. At least one of the inlets is oriented to receive fluid from the exhaust hood via the at least one aperture.

In yet another embodiment, a steam turbine assembly is provided. The steam turbine assembly includes a steam turbine including a header and an exhaust system. The exhaust system includes an exhaust hood including an input and an output. The input is configured to receive fluid discharged from the steam turbine. The exhaust hood further includes a first side wall that extends between the input and the output. The first side wall includes at least one aperture defined therein. The exhaust system also includes an ejector coupled to the exhaust hood, wherein the ejector includes a plurality of inlets and at least one outlet. At least one of the inlets is oriented to receive fluid from the exhaust hood via the at least one aperture.

DETAILED DESCRIPTION OF THE INVENTION

The methods and apparatus described herein are directed to an exhaust system that may be used with a turbine assembly. The exhaust system includes an exhaust hood and an ejector that work in combination to facilitate improved diffusion performance and improved static pressure recovery. More specifically, in the exemplary embodiment, the ejector is either a single-stage or a multi-stage ejector that facilitates reducing flow separation within the exhaust hood. Flow separation is reduced by inducing at least one of a suction effect and a blowing effect to the exhaust hood. As such, steam turbine efficiency is facilitated to be improved, and expenses associated with the turbine assembly are reduced.

Figure 1:
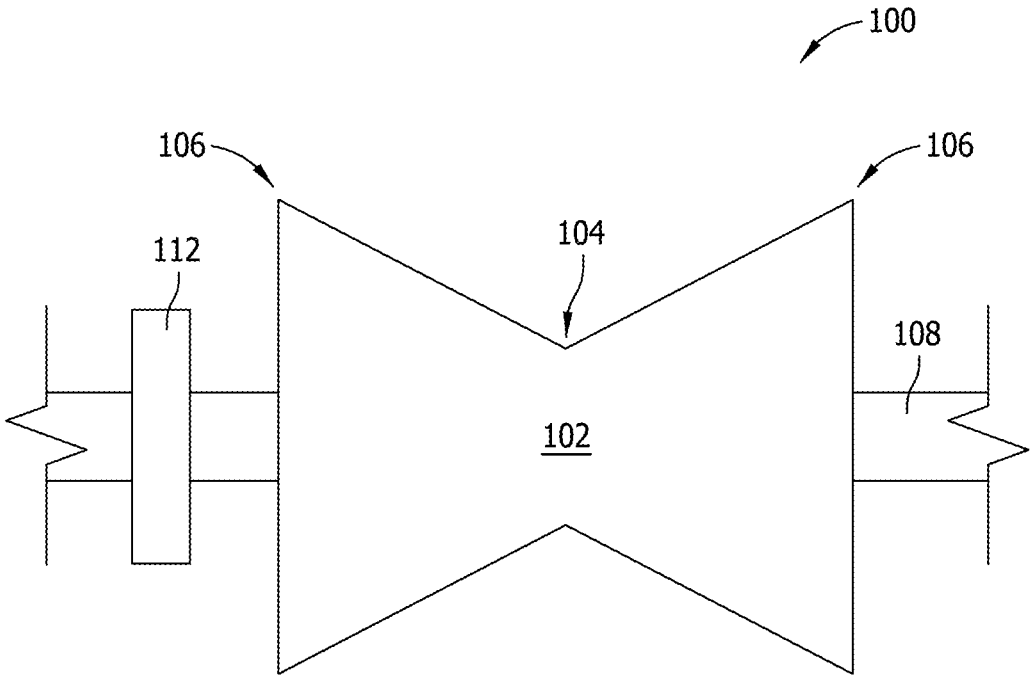
FIG. 1 is a schematic view of an exemplary known steam turbine assembly.
Figure 2:
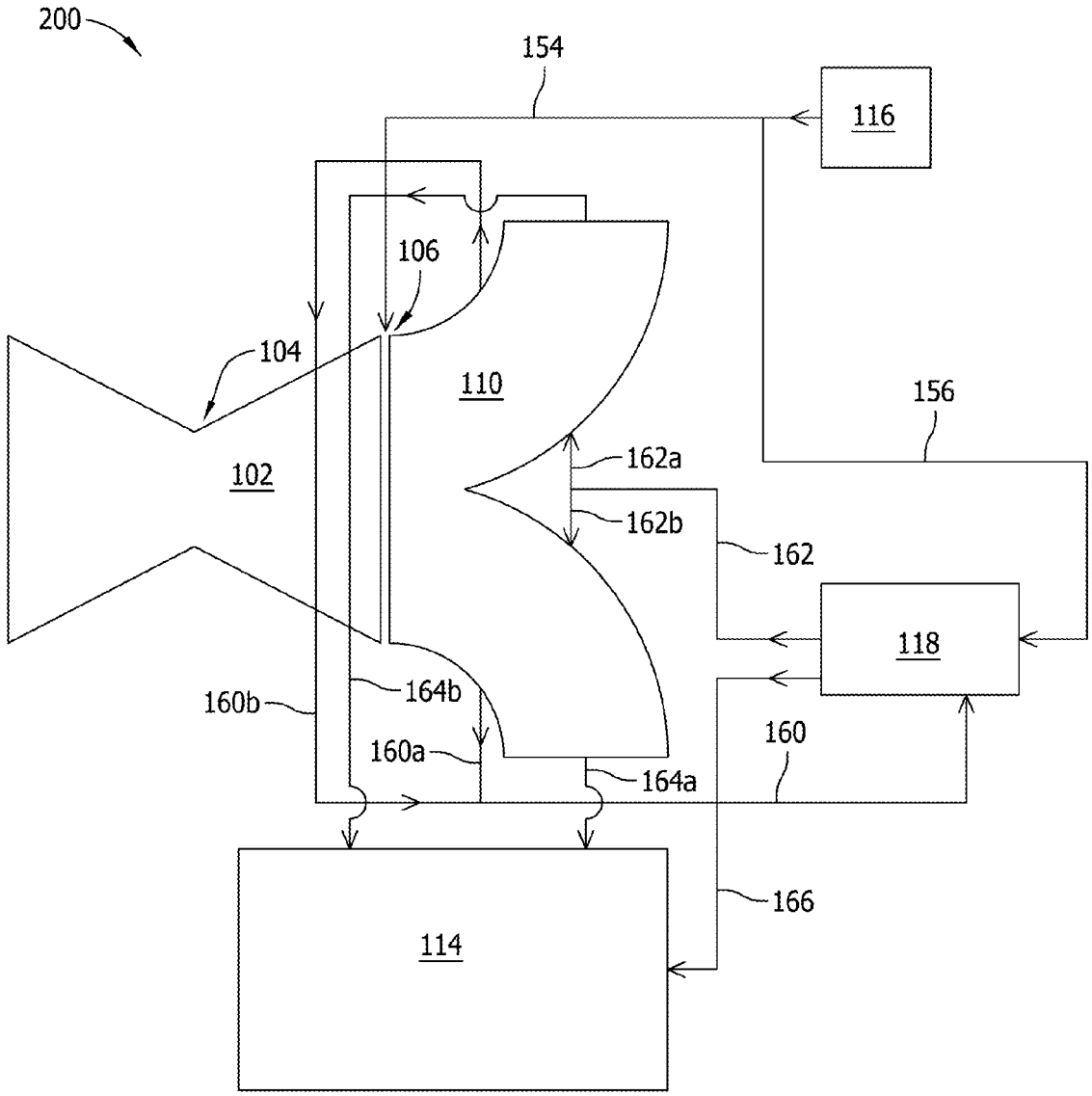
FIG. 2 is a schematic view of an exemplary exhaust system that may be used with the steam turbine assembly shown in FIG. 1.

FIGS. 1 and 2 are schematic views of view of an exemplary steam turbine assembly 100 and an exemplary exhaust system 200. In the exemplary embodiment, turbine assembly 100 includes a steam turbine 102 that includes a high pressure (HP) section 104 and a low pressure (LP) section 106. A rotor shaft 108 extends through turbine sections 104 and 106 and includes a bearing 112. Bearing 112 supports shaft 108 and is adjacent to LP section 106. An exhaust hood 110 is positioned downstream from LP section 106 and is oriented to receive fluid discharged from steam turbine 102. Exhaust hood 110 channels fluid 164*a* and 164*b* discharged from steam turbine 102 towards a condenser 114.

In the exemplary embodiment, exhaust system 200 includes exhaust hood 110, a steam seal header 116, and an ejector 118. In the exemplary embodiment steam seal header 116 provides a pressurized flow of fluid 154, such as steam, to LP section 106 for sealing purposes. Steam 156 from steam seal header 116 that is not used for sealing purposes is channeled towards ejector 118. Furthermore, in the exemplary embodiment, ejector 118 receives fluid directed from exhaust hood 110 and channels fluid to exhaust hood 110 and/or condenser 114. As such, ejector 118 uses steam 156 that would normally be channeled to condenser 114. Furthermore, in the exemplary embodiment, exhaust hood 110 includes two diffusing passages (not shown). However, it should be understood that exhaust hood 110 may include any suitable number of diffusing passages such that exhaust hood 110 functions as described herein. As such, in the exemplary embodiment, steam 160*a* and 160*b* is drawn from exhaust hood 110 and steam 162*a* and 162*b* is received at exhaust hood 110.

Figure 3:
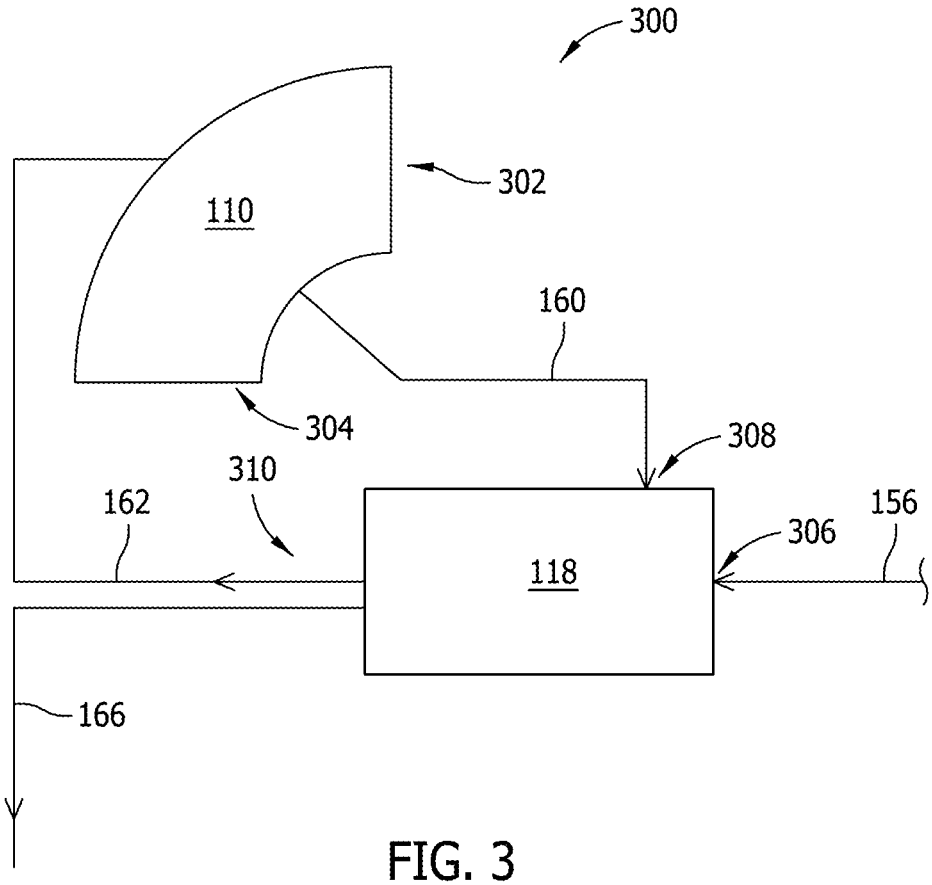
FIG. 3 is a schematic view of the exemplary exhaust system shown in FIG. 2.

FIG. 3 is a schematic view of an exemplary exhaust system 300 that may be used with steam turbine assembly 100 (shown in FIG. 1). Exhaust system 300 includes exhaust hood 110 and ejector 118. Exhaust hood 110 includes an input 302 that is sized and oriented to receive fluid discharged from steam turbine 102 (shown in FIG. 2). Exhaust hood 110 also includes an output 304 that is coupled in flow communication with condenser 114 (shown in FIG. 2) such that steam 164*a* and 164*b* discharged from turbine assembly 100 is channeled through hood 110 towards condenser 114.

Furthermore, in the exemplary embodiment, ejector 118 is coupled in flow communication with exhaust hood 110. For example, in the exemplary embodiment, ejector 118 includes either a single-stage ejector 400 (shown in FIG. 4) or a multi-stage ejector 500 (shown in FIG. 5). In the exemplary embodiment, ejector 118 includes a first inlet 306, a second inlet 308, and an outlet 310. First inlet 306 receives steam 156 from header 116 (shown in FIG. 2) and second inlet 308 receives steam 160 discharged from exhaust hood 110. Ejector 118 also includes at least one outlet 310 for discharging steam 166 to condenser 114 and/or for discharging steam 162 to exhaust hood 110.

Figure 4:
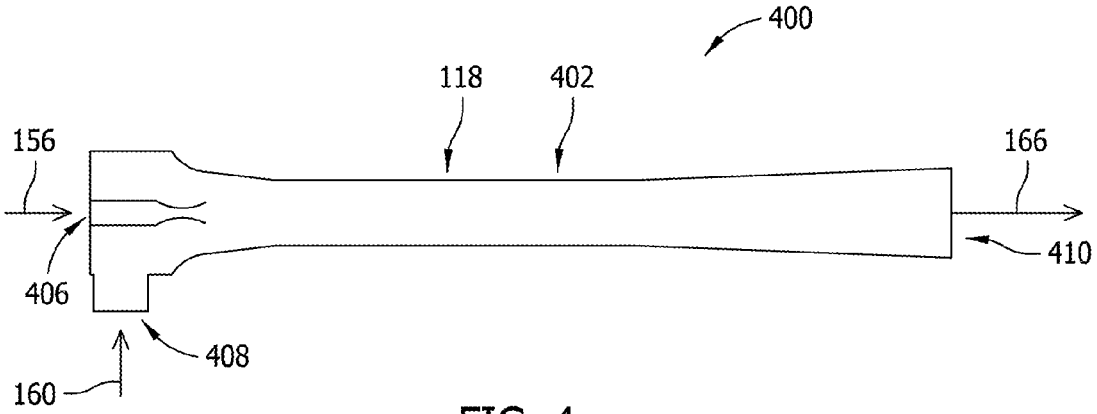
FIG. 4 is a schematic view of an exemplary single stage ejector that may be used with the exhaust system shown in FIG. 3.
Figure 5:
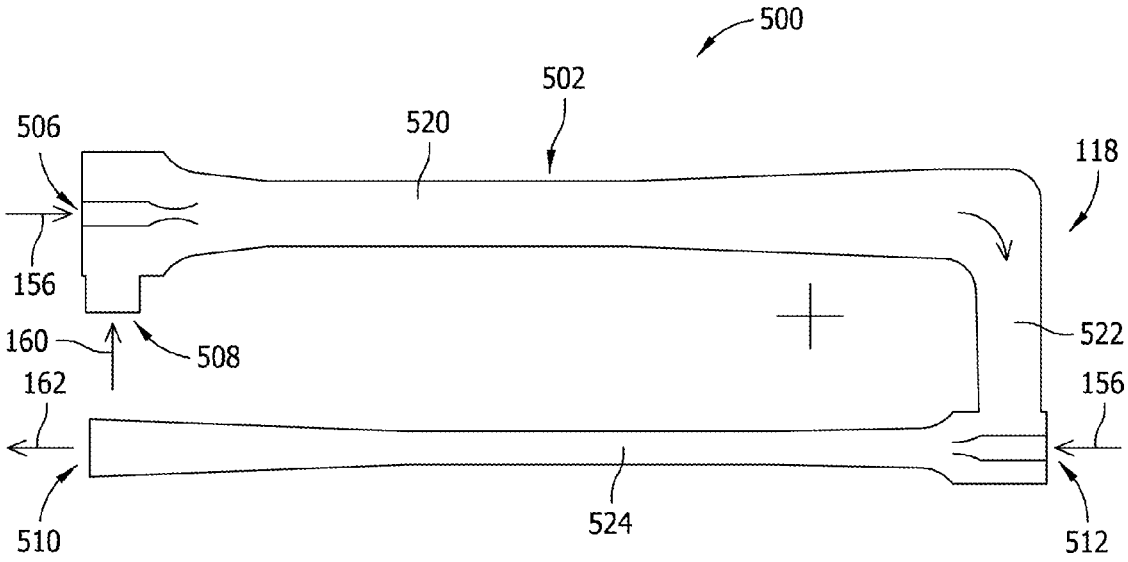
FIG. 5 is a schematic view of an exemplary multi-stage ejector that may be used with the exhaust system shown in FIG. 3.

FIG. 4 is a schematic view of single-stage ejector 400 and FIG. 5 is a schematic view of multi-stage ejector 500 that may be used with exhaust system 300 (shown in FIG. 3). In the exemplary embodiment, ejector 400 includes a housing 402 having a first inlet 406, a second inlet 408, and an outlet 410. Inlet 406 receives steam 156 from header 116 and second inlet 408 receives steam 160 discharged from exhaust hood 110. More specifically, in the exemplary embodiment, steam 156 that enters inlet 406 generates a vacuum within housing 402 such that steam 160 is drawn from exhaust hood 110 into inlet 408. Furthermore, in the exemplary embodiment, single stage ejector 400 discharges steam 166 towards condenser 114.

Multi-stage ejector 500 includes a housing 502 having a first end 520, a second end 524, and an intermediate section 522 that extends between first and second ends 520 and 524. Housing 502 includes a plurality of inlets defined in housing first end 520 and an outlet 510 defined in housing second end 524. For example, in the exemplary embodiment, housing 502 includes a first inlet 506 and a second inlet 508. As such, first inlet 506 receives steam 156 discharged from header 116, inlet 508 receives steam 160 discharged from exhaust hood 110, and outlet 510 discharges fluid to one of condenser 114 and exhaust hood 110. Furthermore, in the exemplary embodiment, multi-stage ejector 500 includes a third inlet 512 defined in intermediate section 522 that receives steam 156 discharged from header 116. As such, steam 156 that enters inlets 506 and 512 generate a vacuum within housing 502 such that steam 160 is drawn from exhaust hood 110 into inlet 508.

Furthermore, in the exemplary embodiment, multi-stage ejector 500 facilitates increasing the pressure of the ejector exit flow 162 as compared to single-stage ejector 400 exit flow 166. Multi-stage ejector 500 receives steam 156 from header 116 via inlets 506 and 512 to facilitate increasing the operating pressure of fluid flowing through multi-stage ejector 500. In the exemplary embodiment, steam 162 exits outlet 510 at a higher pressure than steam 166 that exits single-stage ejector outlet 410 under the same operating conditions. As such, multi-stage ejector 500 may be used in situations when the motive flow steam 156 available from header 116 is not at a sufficient pressure or sufficient flow rate to produce an adequate blowing or combined blowing and suction source for exhaust hood 110.

As such, multi-stage ejector 500 enables steam 156 received from header 116 to be used in turbine assembly 100. Generally, the high temperature of steam 156 limits its ability to be mixed along a steam path (not shown) of turbine assembly 100. Multi-stage ejector 500 uses steam 156 as a motive flow source to generate a vacuum within housing 502 to enable steam 160 to be drawn to inlet 508. Steam 162 exits multi-stage ejector 500 at a lower temperature and pressure than steam 156 entering multi-stage ejector 500. As such, steam 162 discharged from outlet 510 may be used as a blowing source for exhaust hood 110.

Figure 6:
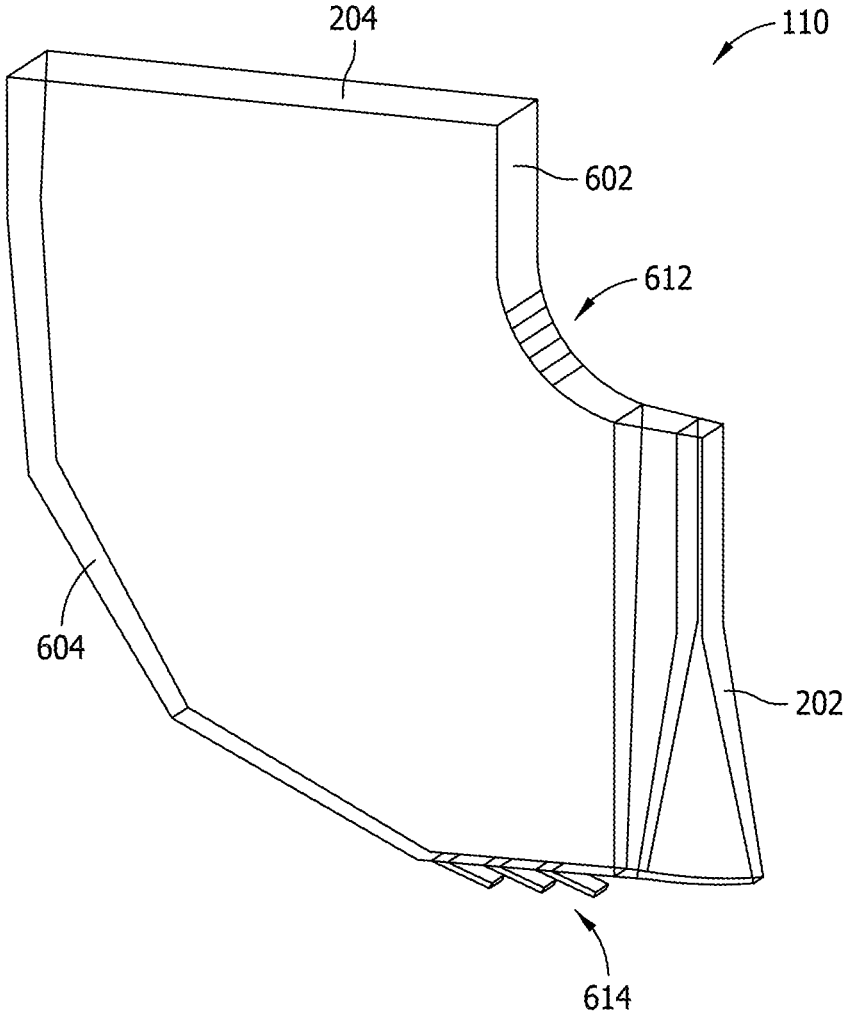
FIG. 6 is a perspective view of an exemplary exhaust hood that may be used with the exhaust system shown in FIG. 3.

FIG. 6 is a schematic view of exhaust hood 110. In the exemplary embodiment, exhaust hood 110 includes an input 202 and an output 204. Input 202 receives steam (not shown) discharged from steam turbine 102 and output 204 discharges steam 164*a* and 164*b* (shown in FIG. 2) to condenser 114 (shown in FIG. 2). Furthermore, in the exemplary embodiment, exhaust hood 110 includes a steam guide 602 and a bearing cone 604. Steam guide 602 is an inner first side wall that that extends between input 202 and output 204 and that includes at least one aperture 612 formed therein. Each aperture 612 discharges steam 160*a* and 160*b* (shown in FIG. 2) from exhaust hood 110 to ejector 118 (shown in FIG. 2). Steam 160*a* and 160*b* that is discharged from aperture 612 is drawn from exhaust hood 110 via a vacuum generated by stream 156 that enters first inlets 406 and 506 (shown in FIGS. 4 and 5). Bearing cone 604 is a radially outer second side wall that extends between input 202 and output 204 and includes at least one port 614 defined therein. Port 614 is coupled in flow communication with outlet 310 such that port 614 receives steam 162 discharged from ejector 118. As such, steam 162 acts as a blowing source for exhaust hood 110.

Suction at steam guide 602 created by the vacuum generated by steam 160 entering first inlets 406 and 506 facilitates improving diffusion performance within exhaust hood 110 by preventing flow separation at steam guide 602. Furthermore, the addition of steam 162 (shown in FIG. 3) to bearing cone 604 as a blowing source facilitates improving diffusion performance within exhaust hood 110 by energizing the boundary layer of bearing cone 604. As such, using steam 162 as a blowing source may be used to improve performance during partial load conditions.

Figure 7A:
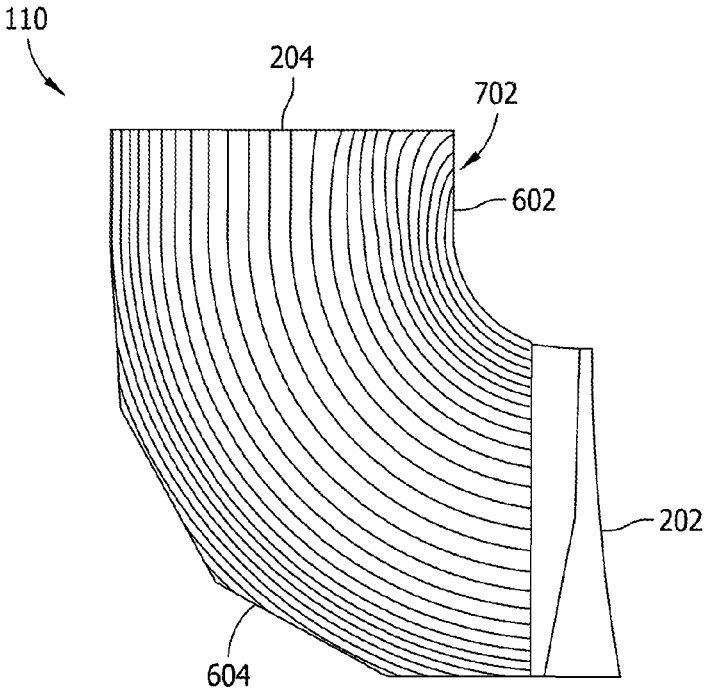
FIG. 7A is a schematic view of exemplary fluid dynamics within an exhaust hood with no fluidic input/output.
Figure 7B:
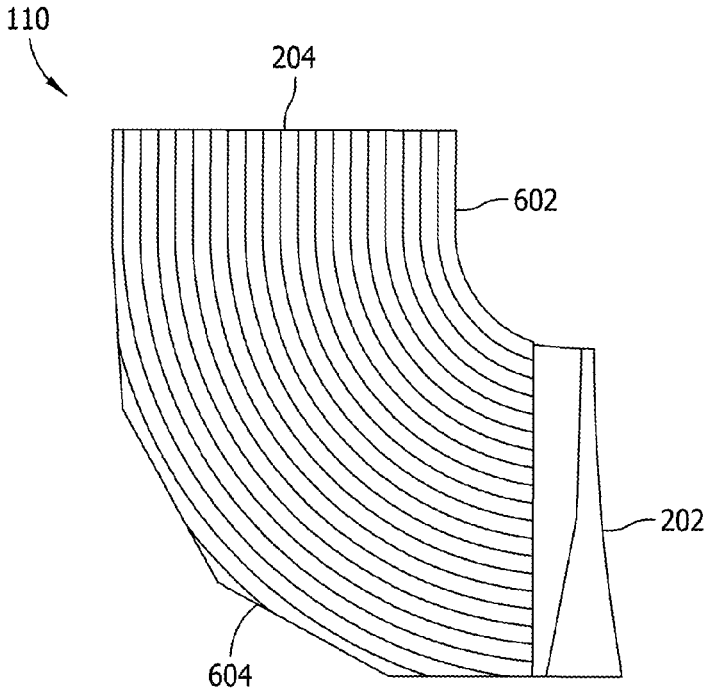
FIG. 7B is a schematic view of exemplary fluid dynamics within an exhaust hood with only steam guide suction.

FIG. 7A is a schematic view of fluid dynamics within exhaust hood 110 with no fluidic input/output and FIG. 7B is a schematic view of fluid dynamics within exhaust hood 110 with only steam guide suction. In the exemplary embodiment, during normal operation, flow separation 702 occurs at steam guide 602 when exhaust hood 110 does not include fluidic input and/or output. The application of steam guide suction and/or bearing cone blowing in FIG. 7B facilitates improving diffusion performance within exhaust hood 110 and facilitates reducing or eliminating flow separation within exhaust hood 110. Furthermore, bearing cone blowing facilitates increasing the velocity of fluid flowing through exhaust hood 110, especially at the boundary layer of bearing cone 604. In the embodiments described herein, steam guide suction is facilitated by either single-stage ejector 400 or multi-stage ejector 500 and bearing cone blowing is facilitated by multi-stage ejector 500. As such, the application of steam guide suction in combination with bearing cone blowing facilitates improving diffusion performance more effectively when compared to the application of only steam guide suction or only bearing cone blowing.

In addition to improving diffusion performance, steam guide suction and bearing cone blowing improves static pressure recovery within the exhaust hood. More specifically, an increase in pressure through the exhaust hood facilitated by steam guide suction and bearing cone blowing increases static pressure recovery. Increased static pressure recovery reduces exhaust loss, thereby increasing turbine efficiency.

Moreover, in known steam turbine assemblies, only a portion of steam flow from a steam seal header is used for sealing purposes at the low-pressure end of a turbine. Generally, the portion of the steam flow that is not used for sealing purposes is directed to a condenser where it is unutilized further. Instead of directing steam to the condenser, the exemplary embodiments described herein use the steam flow to improve the diffusion performance and increase static pressure recovery in known exhaust hood assemblies. As such, overall turbine efficiency is improved and costs associated with turbine assembly operation are reduced.

The methods and apparatus for an exhaust system described herein facilitates enhanced operation of a steam turbine engine. More specifically, the exhaust system described herein facilitates improving diffusion performance in an exhaust hood. Practice of the methods, apparatus, or systems described or illustrated herein is neither limited to an exhaust system, to steam turbine engines generally, nor to dual-flow steam turbines. Rather, the methods, apparatus, and systems described or illustrated herein may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of assembling an exhaust system for use with a turbine, said method comprising:

coupling an exhaust hood including an input and an output to the turbine such that fluid discharged from the turbine enters the exhaust hood, wherein the exhaust hood is defined by at least a first side wall that extends from the input to the output and that includes at least one aperture defined therein;

coupling a multi-stage ejector to the exhaust hood to facilitate reducing flow separation of fluid flowing through the exhaust hood, the multi-stage ejector comprising a housing, the housing comprising a first end, a second end, and an intermediate section that extends from the first end to the second end, the housing comprising a plurality of inlets and at least one outlet; and coupling at least one of the plurality of inlets in flow communication with the exhaust hood to receive fluid discharge from the exhaust hood via the at least one aperture.

2. The method in accordance with claim 1, wherein coupling an ejector to the exhaust hood further comprises coupling at least one port to the at least one outlet, wherein the at least one port is defined in a second side wall that extends between the exhaust hood input and output.

3. The method in accordance with claim 1, wherein said method further comprises coupling at least one of the plurality of inlets in flow communication with the at least one aperture such that fluid is channeled from the at least one aperture to at least one of the plurality of inlets.

4. The method in accordance with claim 1, wherein said method further comprises positioning the exhaust hood between a last stage bucket of the turbine and a bearing.

5. The method in accordance with claim 1, wherein said method further comprises coupling the exhaust hood to a condenser such that the condenser receives fluid discharged from the exhaust hood.

6. The method in accordance with claim 1, wherein said method further comprises coupling a header in flow communication with at least one of the plurality of inlets such that high pressure steam is channeled from the header to at least one of the inlets.

7. An exhaust system for use with a turbine, said exhaust system comprising:

an exhaust hood comprising an input and an output, said input oriented to receive fluid discharged from the turbine, said exhaust hood further comprising a first side wall that extends between said input and said output, said first side wall comprising at least one aperture defined therein; and a multi-stage ejector coupled to said exhaust hood, said multi-stage ejector comprising a housing, said housing comprising a first end, a second end, and an intermediate section that extends from said first end to said second end, said housing comprising a plurality of inlets and at least one outlet, at least one of said plurality of inlets coupled in flow communication to said exhaust hood to receive fluid discharged from said exhaust hood via said at least one aperture.

8. The exhaust system in accordance with claim 7, wherein said exhaust hood further comprises a second side wall extending between said exhaust hood input and output, said second side wall comprising at least one port defined therein, said port configured to receive fluid discharged from said multi-stage ejector.

9. The exhaust system in accordance with claim 7, wherein one of said plurality of inlets receives fluid drawn from said exhaust hood via said aperture, wherein the fluid is drawn by a vacuum generated by fluid entering another of said plurality of inlets.

10. The exhaust system in accordance with claim 7, wherein said multi-stage ejector facilitates improving diffusion performance within said exhaust hood.

11. The exhaust system in accordance with claim 7, wherein said exhaust hood discharge is coupled in flow communication with a condenser.

12. The exhaust system in accordance with claim 7, wherein said multi-stage ejector facilitates increasing the operating pressure of fluid flowing therethrough.

13. The exhaust system in accordance with claim 7, wherein at least one of said plurality of inlets of said multi-stage ejector and an intermediate section inlet each receive fluid from a header.

14. A steam turbine assembly comprising:

a steam turbine that comprises a header; and an exhaust system comprising:

an exhaust hood comprising an input and an output, said input oriented to receive fluid discharged from the turbine, said exhaust hood further comprising a first side wall that extends between said input and said output, said first side wall comprising at least one aperture defined therein; and a multi-stage ejector coupled to said exhaust hood, said multi-stage ejector comprising a housing, said housing comprising a first end, a second end, and an intermediate section that extends from said first end to said second end, said housing comprising a plurality of inlets and at least one outlet, at least one of said plurality of inlets coupled in flow communication to said exhaust hood to receive fluid discharged from said exhaust hood via said at least one aperture.

15. The steam turbine assembly in accordance with claim 14, wherein one of said plurality of inlets receives fluid drawn from said exhaust hood via said aperture, wherein the fluid is drawn by a vacuum generated by fluid entering another of said plurality of inlets.

16. The steam turbine assembly in accordance with claim 14, wherein one of said plurality of inlets receives fluid from said header.

17. The steam turbine assembly in accordance with claim 16, wherein the fluid received from said header is high pressure steam.

18. The steam turbine assembly in accordance with claim 14, wherein said exhaust hood further comprises a second side wall that extends between said exhaust hood input and output, said second side wall comprises at least one port defined therein, said port configured to receive fluid discharged from said multi-stage ejector.

* * * * *